United States Patent [19]

DeVore et al.

[11] Patent Number: 4,512,300

[45] Date of Patent: Apr. 23, 1985

[54] OIL TEMPERATURE CONTROL SYSTEM FOR INTERNAL COMBUSTION ENGINE

[75] Inventors: James R. DeVore, Farmington Hills, Mich.; Leslie A. Roettgen, Columbus, Ind.

[73] Assignee: Cummins Engine Company, Inc., Columbus, Ind.

[21] Appl. No.: 601,307

[22] Filed: Apr. 17, 1984

[51] Int. Cl.[3] ..... F01M 1/00

[52] U.S. Cl. ..... 123/196 AB; 184/6.22; 184/104 A; 184/104 B; 123/41.33

[58] Field of Search ..... 123/196 AB, 196 R; 184/6.22, 104 B, 104 A

[56] References Cited

U.S. PATENT DOCUMENTS

| | | | |
|---|---|---|---|
| 1,931,935 | 10/1933 | Paugh | 123/196 AB |
| 2,133,514 | 10/1938 | Holmes | 123/196 AB |
| 2,788,176 | 4/1957 | Andersen | 123/196 AB |
| 4,027,643 | 6/1977 | Feenan et al. | 123/196 AB |

*Primary Examiner*—E. Rollins Cross

*Attorney, Agent, or Firm*—Neuman, Williams, Anderson & Olson

[57] ABSTRACT

A system is provided for regulating the oil temperature of a diesel engine while the latter is in various operating modes. The engine includes a heat exchange unit through which a heat exchange medium circulates and while the engine is in certain operating modes, the system directs the oil flow through the heat exchange unit so that the oil is either heated or cooled by the circulating heat exchange medium. The system includes a valve housing provided with a cavity having an oil inlet port, first oil outlet ports connected to the heat exchange unit, and a second oil outlet port connected to a passage for bypassing the unit. Disposed within the cavity is an adjustable element for effecting interconnection between the inlet port and a selected outlet port. Adjustment of the valve element within the cavity is determined by the oil temperature during predetermined operating modes of the engine. When the engine is in a warm-up or first mode, the valve element interconnects the inlet port with a first outlet port, thereby effecting rapid heating of the oil by the circulating heat exchange medium. When the engine is in a second mode, the oil temperature is within a predetermined temperature range and the adjusted valve element effects interconnection between the inlet and second outlet ports causing the oil to bypass the unit. When the engine is operating in a third mode wherein the oil temperature is above the predetermined range, the valve element is adjusted so as to effect interconnection between the inlet and the other first outlet port, causing the oil to be cooled by the circulating heat exchange medium.

5 Claims, 2 Drawing Figures

FIG. 1
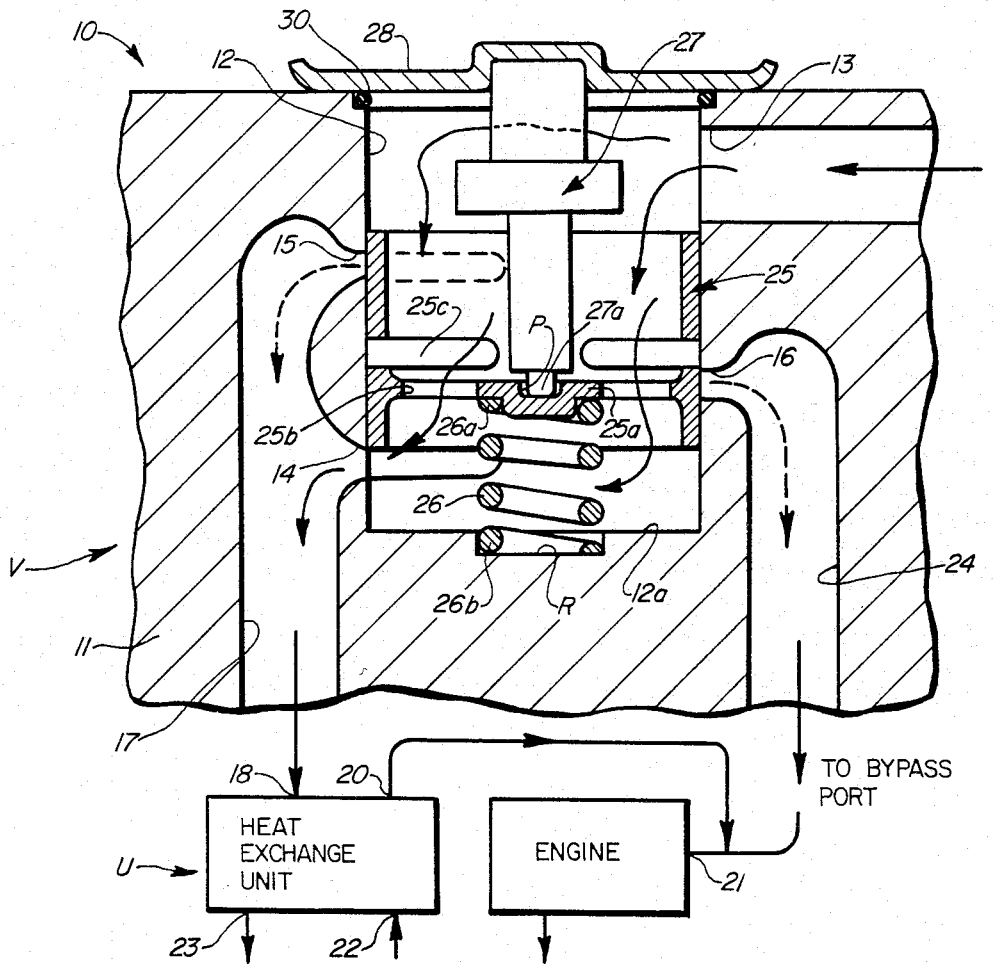
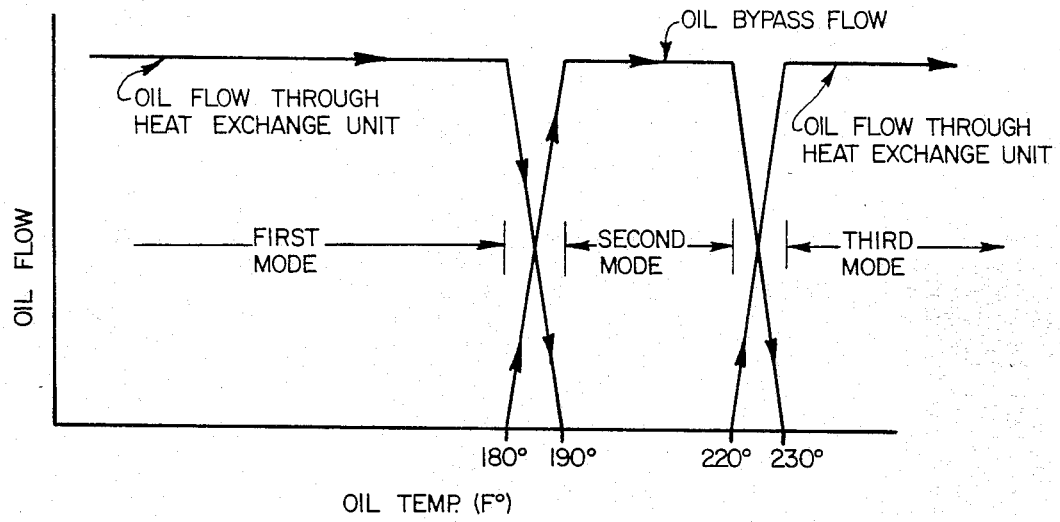
FIG. 2

OIL TEMPERATURE CONTROL SYSTEM FOR INTERNAL COMBUSTION ENGINE

BACKGROUND OF THE INVENTION

In internal combustion engines, such as diesel engines, warm-up of the engine, particularly under certain climatic conditions, involves an inordinate amount of time. During such warm-up period the various moving components of the engine frequently encounter substantial frictional resistance, requiring the engine to produce more horsepower than would otherwise be the case in order to compensate for such resistance. Thus, in many diesel engines, in order to remedy this situation, a separate heater is utilized to effect rapid heating of the oil and thus, reduce significantly the power loss occasioned during this period in overcoming such frictional resistance. It has also been found with diesel engines that a more efficient operation results if the temperature of the oil remains relatively constant within a predetermined temperature range. To maintain the oil temperature within such a range, it has become a common practice in diesel engine design to employ a separate cooling unit. Thus, to utilize a separate oil heater and a separate cooling unit in an engine is costly, requires additional space to accommodate the engine, and oftentimes such accessories or components involve an inordinate amount of maintenance and servicing.

SUMMARY OF THE INVENTION

Thus, it is an object of the invention to provide an oil temperature control system utilizing a single heat exchange unit to effect rapid heating of the oil during one mode of engine operation and cooling of the oil during another mode of engine operation.

It is a further object to provide an oil temperature control system wherein a single three-mode operating thermostat is utilized and automatically regulates the oil flow within the engine so as to attain optimum operating efficiency of the engine.

It is a still further object to provide an oil temperature control system which significantly reduces engine wear, minimizes maintenance and servicing costs, and automatically maintains the oil temperature within a predetermined range.

Further and additional objects will appear from the description, accompanying drawing, and appended claims.

In accordance with one embodiment of the invention a system is provided for regulating the oil temperature within a diesel engine when the latter is in various operating modes. The engine includes a heat exchange unit through which a heat exchange medium circulates and the oil flows when the engine is operating in certain modes; and a passage through which the oil flows and bypasses the unit when the engine is operating in another mode. Oil flow through either the heat exchange unit or the bypass passage is effected by a valve. This valve includes a housing having an elongated cavity provided with an oil inlet port, first oil outlet ports connected to the heat exchange unit; a second oil outlet port connected to the bypass passage; and means adjustably mounted within the cavity for effecting interconnection of the inlet port with a selected outlet port. Adjustment of the valve means is determined by a sensor which senses the temperature of the oil flow at the inlet during operation of the engine, and adjusts the valve means accordingly. When the engine is operating in a first mode, the oil temperature is below a predetermined temperature range and the valve means interconnects the inlet port and a first outlet port so that the oil is rapidly heated in the unit to within the temperature range by the circulating heat exchange medium. When the engine is operating in a second mode and the oil temperature is within a desired range, the valve means is automatically adjusted so that the oil flows through the bypass passage rather than through the heat exchange unit. When the engine is in a third operating mode and the oil temperature is above the desired temperature range, the valve means is automatically adjusted so that the oil flows out of the housing cavity through the second of the first outlet ports and through the heat exchange unit whereby the oil is cooled to within the desired temperature range by the circulating heat exchange medium.

DESCRIPTION

For a more complete understanding of the invention reference should be made to the drawing wherein:

FIG. 1 is a fragmentary diagramatic view of one embodiment of the improved control system and showing in enlarged section the three-way valve of the system with the valve means thereof disposed in a predetermined relative position within the housing cavity while the engine is in a first operating mode.

FIG. 2 is a graph showing the oil flow through the heat exchange unit or bypass passage in relation to the temperature of the oil during various operating modes of the engine.

Referring now to the drawing, one embodiment of the improved system 10 is shown for use in controlling the temperature of the oil flow within a diesel engine when the latter is in various operating modes. For example, a first mode may occur when the engine is in a start-up or warm-up condition and the oil temperature is below a predetermined amount (e.g., 180° F.). When the engine is operating in the first mode it is important that the oil be heated as rapidly as possible, thus reducing friction and wear between various moving engine components.

A second operating mode occurs when the temperature of the oil is within the desired range (e.g., 185° F.–225° F.).

A third mode may occur when the oil temperature of the engine exceeds a predetermined amount (e.g., 220° F.). For the most efficient operation of the engine and the most desirable combustion of the fuel oil, it has been found to occur when the oil introduced into the combustion chambers is within the aforementioned desired temperature range.

To attain the desired results during the various operating modes of the engine, the improved system utilizes a single heat exchange unit U through which circulates a heat exchange medium, such as a mixture of water and antifreeze solution and during certain engine operating modes, the oil flows therethrough as well. The circulating heat exchange medium effects either heating or cooling of the oil depending upon the relative temperatures of the medium and oil. To direct the oil flow to the heat exchange unit or cause the flow to bypass the unit, the improved system is provided with a valve V, see FIG. 1. Valve V in the illustrated embodiment is a three-way type and includes a housing 11 in which is formed an elongated cavity 12. Communicating with the cavity 12 are an oil inlet port 13 through which a considerable portion of the oil for the engine flows; a pair of first outlet ports 14, 15; and a second outlet port 16. As observed in FIG. 1, inlet port 13 is disposed adjacent one end of the cavity and outlet ports 14, 15, and 16 are arranged in longitudinally spaced relation with respect to the inlet port and to each other as well. Second outlet port 16, is disposed at a longitudinal distance from inlet port 13 which is greater than that of first outlet port 15, but is less than that of the other first outlet port 14.

Both of the first outlet ports 14, 15 communicate with a common passage 17 formed in the housing, which leads to an oil inlet 18 provided on the heat exchange unit U. The unit is also provided with an oil outlet 20 which, in turn, communicates with an oil inlet 21 provided on the engine. Prior to the oil reaching the engine inlet 21, it will normally flow through a conventional filter, not shown. Suitable ports 22, 23 are provided in unit U so as to permit circulating of a suitable heat exchange medium through the unit.

Outlet port 16 of the housing 11 communicates with a passage 24 which leads directly to the engine oil inlet 21 and thus causes the oil to bypass the heat exchange unit.

Interconnection between the inlet port 13 of the housing 11 and a selected one of the outlet ports 14, 15, 16 thereof is effected by an element 25 (e.g., having a spool-like cylindrical configuration) which is mounted for selective, sliding, axial movement within the housing cavity 12. As seen in FIG. 1, one side of the element is engaged by a biasing spring 26 causing the element to normally assume a position within the cavity wherein the inlet port 13 and outlet port 14 are interconnected. When such interconnection occurs, all of the oil flows through the heat exchange unit. This relative position of the element 25 would occur when the engine is in the first or start-up mode. In such a situation, the heat exchange medium circulating through the heat exchange unit quickly heats up to a temperature substantially greater than the oil flowing therethrough; thus, causing rapid heating of the oil flowing through the unit. Such a situation is graphically illustrated in the lefthand side of the graph shown in FIG. 2.

Opposing the biasing force of spring 26 is a device 27, such as a wax servomotor or the like, the operation of which is responsive to the temperature of the oil flowing through the inlet port 13. The device 27 is provided with an axially adjustable plunger 27*a*, which engages a centrally disposed shallow pocket P provided in a cross partition 25*a* formed in the interior of element 25. The opposite side of the partition is engaged by the end 26*a* of the biasing spring 26. The opposite end 26*b* of the spring engages a centrally disposed recess R formed in an endwall 12*a* of cavity 12.

Formed in partition 25*a* and symmetrically arranged about pocket P are a plurality of openings 25*b* through which oil from inlet port 13 is adapted to flow. As will be observed, the opposite ends of element 25 are open. Formed in the cylindrical wall of element 25 and upstream from partition 25*a* is an elongated curved slot 25*c*. The locations of slot 25*c* and the cross partition 25*a* from the ends of the element are such that, when the element is in the position shown in FIG. 1, which occurs when the engine is in the first operating mode, the portion of the cylinder wall extending upstream from the partition 25 blocks off outlet port 15. At the same time, slot 25*c* is blocked off by the cavity wall and the cylinder wall of the element blocks off outlet port 16. The axial length of the element 25 is such that, when both ports 15, 16 are completely blocked, the end of the element fully uncovers port 14.

When the engine is operating under normal conditions (second mode)—that is to say, the oil temperature is within the predetermined, desired range 185° F.–225° F., the spool-like element 25 will automatically be moved away from inlet port 13 by the plunger 27*a* of device 27 an amount which is sufficient to allow slot 25*c* to become aligned with port 16 while the cylindrical wall of the element simultaneously blocks outlet ports 14, 15.

When, however, the engine is operating in a third mode wherein the oil temperature exceeds a predetermined amount (e.g., 220° F.) the thermo-sensitive device 27 will automatically move the element 25 further away from the inlet port 13 until outlet port 15 is fully uncovered while simultaneously therewith outlet ports 14, 16 are fully blocked.

As will be observed in FIG. 2, when the engine operating mode changes from the first mode to the second mode, or vice versa, there is a short time period when the oil temperature is between 180° F. and 190° F. During this period ports 14, 16 are simultaneously partially uncovered. A similar situation with respect to ports 15, 16 occurs when the engine operating mode changes from a second mode to a third mode, or vice versa, wherein the oil temperature is between 220° F. and 230° F.

As seen in FIG. 1, device 27 is supported by a cover plate 28 which overlies and closes off one end of cavity 12. A suitable seal 30 is provided between the cover plate and the cavity end. While it has been suggested that the thermo-responsive device may be a conventional wax servo motor, it is not intended to be limited thereto. Other well known means may be readily substituted for the wax servo motor to effect the desired adjustment of element 25.

Thus, it will be noted that a simple, inexpensive and effective system has been disclosed for automatically controlling the oil temperature in a diesel engine.

We claim:

1. In a diesel engine, a system for regulating the oil temperature during predetermined engine operating modes, said system comprising a single heat exchange unit through which all of the oil is adapted to flow when the engine is operating in certain modes; a single passage through which all of said oil is adapted to flow and bypass said unit when the engine is operating in another mode; a single valve having a housing provided with an oil inlet port, longitudinally spaced first oil outlet ports communicating with said unit, a second oil outlet port disposed intermediate said first outlet ports and communicating with said bypass passage, and adjustable means effecting interconnection between said oil inlet port and a selected outlet port; and temperature sensing means operatively connected to said valve means to effect adjustment thereof in accordance with said engine operating modes; when in a first mode wherein the oil temperature is below a predetermined temperature range, said valve means effecting interconnection of said inlet port and one of said first outlet ports whereby all of said oil is heated in said unit to within said predetermined temperature range; when in a second mode wherein the oil temperature is within said predetermined temperature range, said valve means effecting interconnection of said inlet port and said second outlet port causing all of said oil to bypass said unit; and when in a third mode wherein the oil temperature is above said predetermined temperature range, said valve means effecting interconnection of said inlet port and the other of said first outlet ports causing all of said oil to be cooled within said unit.

2. The system of claim 1 wherein the unit is provided with a circulating heat-exchange medium; during the first mode, said medium having a temperature higher than the oil temperature, and during the third mode, said medium having a temperature lower than the oil temperature.

3. The system of claim 1 wherein the valve housing includes an elongated cavity formed therein, one end of said cavity communicating with the inlet port; said first and second outlet ports being longitudinally spaced from said inlet port and from each other and being in communication with said cavity; said valve means including a spool-like element movable in a longitudinal direction within said cavity, said element being provided with a plurality of passage means, one passage means effecting interconnection of said inlet port with one of said first outlet ports when said spool-like member is disposed in a predetermined first relative position within said cavity, a second passage means effecting interconnection of said inlet port with said second outlet port when said spool-like member is disposed in a predetermined second relative position within said cavity, and when said spool-like member is disposed in a predetermined third relative position within said cavity, said inlet port being interconnected to the other of said first outlet ports.

4. The system of claim 1 wherein the predetermined temperature range of the oil is from about 180° F. to about 230° F.

5. The system of claim 3 wherein positioning of the spool-like member within the cavity is effected by a thermal responsive actuating means exerting predetermined forces in one direction on said member in opposition to a biasing means exerting opposing forces on said spool-like member, said actuating means being responsive to the temperature of the oil flowing through the oil inlet port.

* * * * *